US011672327B1

(12) United States Patent
Mongan

(10) Patent No.: US 11,672,327 B1
(45) Date of Patent: Jun. 13, 2023

(54) ARTICULATING BODY BRUSH

(71) Applicant: TAO Clean, LLC, Orange, CA (US)

(72) Inventor: Ryan Mongan, Orange, CA (US)

(73) Assignee: TAO Clean, LLC, Orange, CA (US)

( * ) Notice: Subject to any disclaimer, the term of this patent is extended or adjusted under 35 U.S.C. 154(b) by 338 days.

(21) Appl. No.: 17/161,410

(22) Filed: Jan. 28, 2021

Related U.S. Application Data

(60) Provisional application No. 63/070,130, filed on Aug. 25, 2020.

(51) Int. Cl.
*A46B 13/02* (2006.01)
*A46B 5/00* (2006.01)
*A46B 13/00* (2006.01)

(52) U.S. Cl.
CPC ..... *A46B 13/02* (2013.01); *A46B 5/002* (2013.01); *A46B 5/0054* (2013.01); *A46B 13/008* (2013.01); *A46B 2200/10* (2013.01)

(58) Field of Classification Search
CPC ..... A46B 13/00; A46B 13/02; A46B 13/008; A46B 5/0004; A46B 5/0008; A46B 5/0012; A46B 5/002; A46B 5/0054; A46B 5/0075; A46B 5/0083; A46B 2200/10; A46B 2200/1006; A46B 2200/102
See application file for complete search history.

(56) References Cited

U.S. PATENT DOCUMENTS

| | | | | |
|---|---|---|---|---|
| 4,724,567 | A | 2/1988 | Rones | |
| 8,534,935 | B2 | 9/2013 | Aab | |
| 8,545,516 | B1 | 10/2013 | Winnett et al. | |
| 10,383,486 | B2 | 8/2019 | Nichols | |
| 2009/0282634 | A1* | 11/2009 | Pardini | A46B 7/02 15/172 |
| 2014/0330289 | A1* | 11/2014 | Revivo | A46B 13/02 606/131 |

FOREIGN PATENT DOCUMENTS

EP 3 446 593 A1 * 2/2019

* cited by examiner

*Primary Examiner* — Randall E Chin
(74) *Attorney, Agent, or Firm* — Thomas M. Freiburger

(57) ABSTRACT

A rotatable body brush, preferably driven by an electric motor, has pivoted segments in the brush or working element. The segments swing outwardly when the user desires a larger-diameter brush, and can be retained inwardly when a smaller brush, such as a face brush, is desired.

17 Claims, 12 Drawing Sheets

ARTICULATING BODY BRUSH

BACKGROUND OF THE INVENTION

This application claims benefit of provisional application Ser. No. 63/070,130, filed Aug. 25, 2020.

This invention concerns brushes, more particularly a motor-driven body brush.

There exist in the marketplace devices known as powered facial brushes. While they vary in appearance, the general configuration is a handle (as shown in FIG. 1, prior art) containing a motor and either a power source such as a battery or a cord to attach the handle to a remote power source. This handle imparts a motion to a brush head (FIG. 1). This motion can take several different forms but a very popular form is a simple rotation about a longitudinal axis. The user holds onto the handle and the working end is the surface of the brush head distal from the handle.

When the brush head is investigated in more depth, it often has a main body (item 30, FIG. 1) and a field of working elements (item 78, FIG. 1). These working elements are often pumice stone, sponge, elastomer field, elastomer bristles or nylon bristles, among others. When nylon bristles are used, they are often comprised of tufts (item 73, FIG. 1). There are often one hundred or more tufts on one brush head. Each tuft may contain hundreds of individual nylon (or other material) fibers (item 76, FIG. 1). When the tufts are removed, and the main body of the facial brush remains, it often looks like FIG. 2 which shows a prior art field of tuft holes (shown typically and without specificity of location as item 70 throughout the figures). Much of the following description and figures will eliminate these tufts for clarity, relative to the invention. Other figures will show fields of uniform working material or bristles. The fields of uniform working material can be interpreted as pumice, a sponge or such single piece elements. But, in all figures the working elements are interchangeable and are independent of the novelty of the design of this invention.

A brush head like that described above and shown in FIG. 1 is useful for cleaning the intricacies of one's face if the brush is fabricated in the proper scale. The brush head needs to reach into crevasses and recesses such as the recess between the side of the nose and the cheek and in and around the eyes and ears. Other parts of the body can also benefit from the cleaning power of the powered facial brush but often the scale of the brush head itself makes that impractical or at least less than ideal. Body parts such as the arms, legs and chest could benefit from a powered brush and these area don't possess much of the same intricacies as the face. Because of that, some devices also come with different heads specifically for these body parts and the brushes are known as body brushes. However, this requires the user to purchase extra components—multiple heads for specific body parts. In addition, some systems take advantage of the small scale of the facial brush head and are diminutive systems as a whole. Because of this they are easy to store and easy to travel with. Those systems that have multiple heads and especially have large heads lose this advantage. Thus, there is an opportunity in the market for a small scale powered facial brush system that can also effectively double as a powered body brush while still maintaining a small size.

SUMMARY OF THE INVENTION

This invention breaks up the traditional single working element field into several different fields. At least one, and preferably at least two, of these fields articulate from a closed to an open position whereby in the open position the largest distance between the central longitudinal rotation axis and the working element is greater than in the closed position, that is, the diameter of the rotatable head is increased. And, as mentioned, a larger working element is able to clean large expanses of skin faster. Because this head is configurable, it can transform from one that is used on intricate body parts (e.g. the face) to one that is used on larger, less intricate body parts (e.g. legs).

In a preferred embodiment at least two symmetrically-arranged working element sections are swingable outwardly from closed to open position when a larger brush head is desired. When closed they tuck together and form an essentially circular perimeter.

DESCRIPTION OF THE DRAWINGS

In FIGS. 3A through 7 the brush head of the invention is shown without tufts or bristles or other working elements.

FIG. 3A shows the brush head in perspective, from the proximal side, with articulated sectors swung outwardly.

FIG. 6 is a perspective view similar to FIG. 3A, with the sectors in open position, exploded as to a central sector which is displaced outwardly to reveal an optional mechanism of the brush head.

DESCRIPTION OF PREFERRED EMBODIMENTS

A brush head according to the invention is illustrated in FIGS. 3 through 13B.

Figure 8:
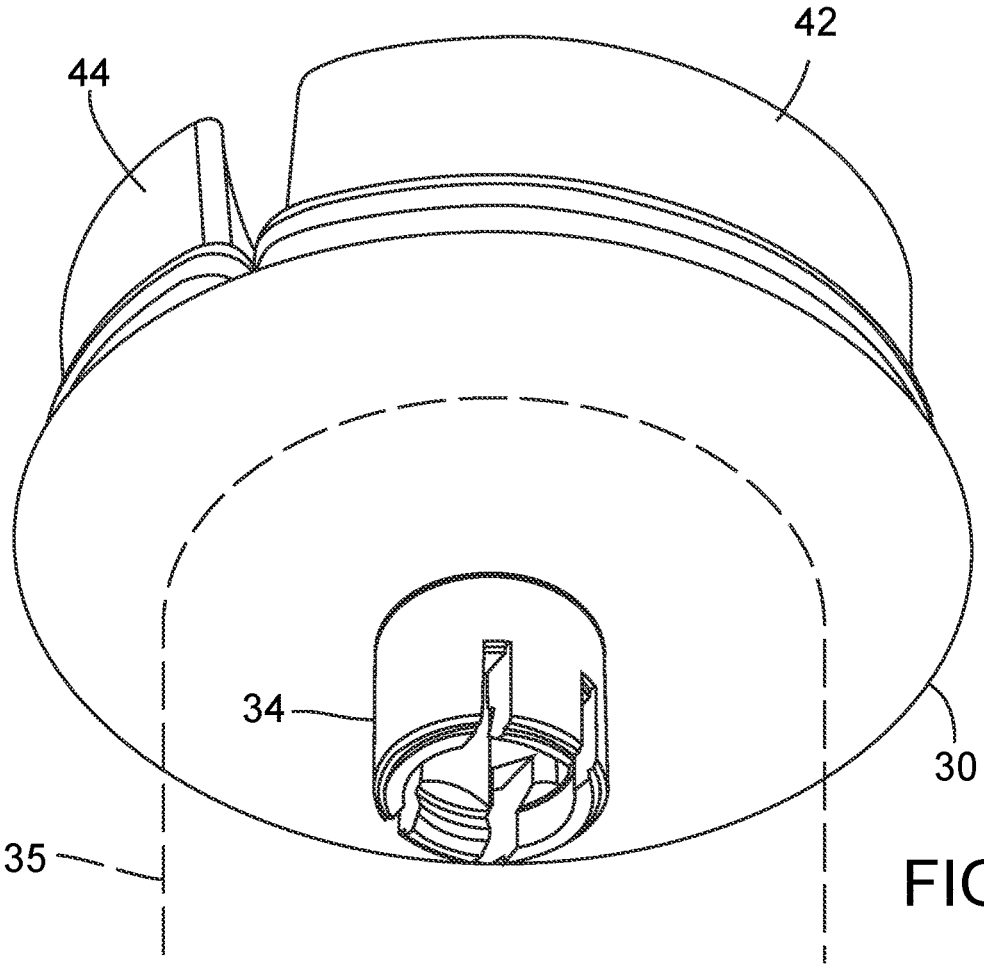
FIG. 8 is a perspective view showing the brush head from a proximal side, with solid working elements.

When viewed from the proximal side (FIG. 8), the brush head of the invention has a handle interface (item 34, FIG. 8). This handle interface is the manner in which the brush head is connected, preferably removably, to the handle. It is also often the manner in which power and motion is transmitted from the handle to the brush head. The handle 35, indicated only in dashed lines, preferably includes the electric motor that drives the rotatable brush head.

Figure 9:
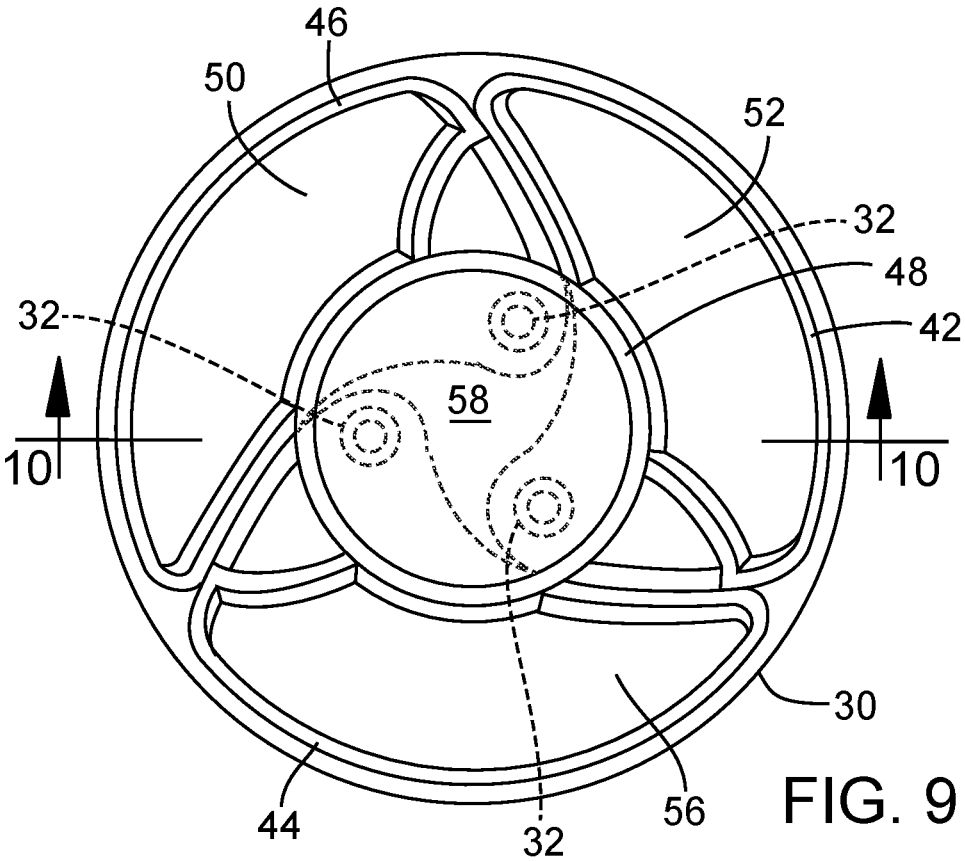
FIG. 9 is a plan view showing the brush head from the distal side, the sectors being in closed position.
Figure 10:
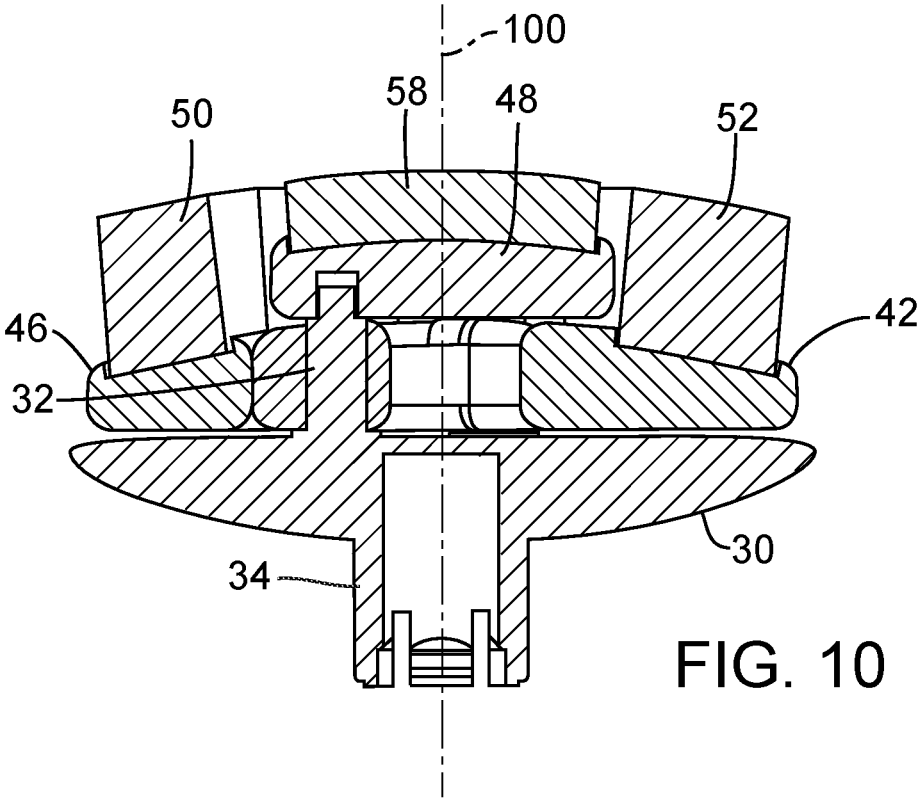
FIG. 10 is a cross section view of the brush head of FIG. 9, the working elements being continuous rather than bristles.

When viewed from above (FIG. 9) the brush head is comprised of several working element segments for contacting the skin (items 50, 52, 56 and 58, FIG. 9) attached to several working element holders (items 42, 44, 46 and 48 respectively, FIG. 9). The holders 42, 44 and 46 articulate relative to the main body 30, as opposed to the center holder 48, which does not. The articulating working element holders allow for articulation of the working elements (50, 52, 56) that was not possible previously when the working element was affixed directly to the main body essentially as a single body. In FIGS. 9 and 10 the working element segments are shown as uniform material as opposed to tufts of bristles as mentioned above. "Segments" herein refers to holders and/or working elements.

In this design the sectors 42, 44 and 46 articulate outwardly and inwardly while the center sector 48 remains fixed to the main body 30. This articulation is accomplished by means of rotation of the working element holders about a shaft from the main body (one such pivot shaft is shown in crossection as item 32, FIG. 10). The sectors pivotally attach to these shafts and allow pivoting from the closed position of FIGS. 9 and 10 to an open, outwardly swung position as indicated in FIGS. 3-6. Alternative designs that accomplish the same motion would have positive shaft features emerging from the working element holders and a pivoting hole in the body 30. As another alternative a positive shaft feature could emerge from the center sector 48 and extend all the way to 30 allowing 42, 44 and 46 to pivot about it.

FIGS. 3 to 6 show the open and closed positions for this embodiment, showing the sectors without working elements. It is obvious from these views that the effective diameter of the brush is larger in the open position. This can be seen further in the distal end views of FIG. 4A and FIG. 4B where a radius between the center of rotation and the most radially distant tuft hole (radii designated as R and R') is considerably greater in the open condition than in the closed position. As this brush head (FIG. 4A) rotates in the counterclockwise direction (as seen from the distal end), R' sweeps out a larger circumference than R in the closed position (FIG. 4B). Therefore, the field of working elements sweep out a larger diameter and area in FIG. 4A than in FIG. 4B. Thus, the brush head can be kept in the closed position for small intricate areas and be opened for larger, less intricate areas. As designed in this embodiment, the amount of rotational articulation of 42, 44 and 46 to achieve maximum R' is approximately 150° about each of the respective pivots (32 in FIG. 10). As an example, R' can be maximized when the most distant tuft 73 (FIG. 7B) is in line with the center of the rotation of working element holder 42 and the center of the facial brush rotation.

Figure 1:
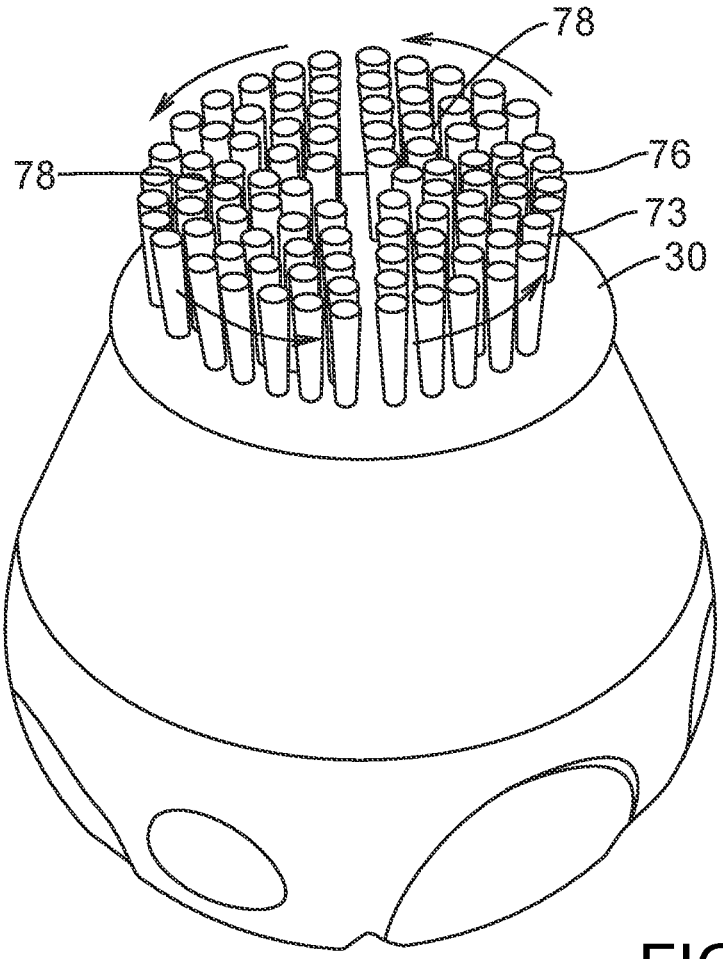
FIG. 1 PRIOR ART
FIGS. 1 and 2 show rotatable brushes in accordance with prior art.
Figure 2:
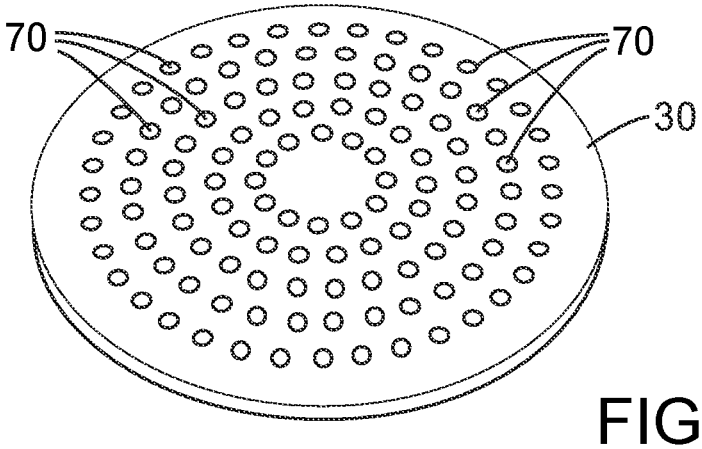
FIG. 2 PRIOR ART
Figure 3A:
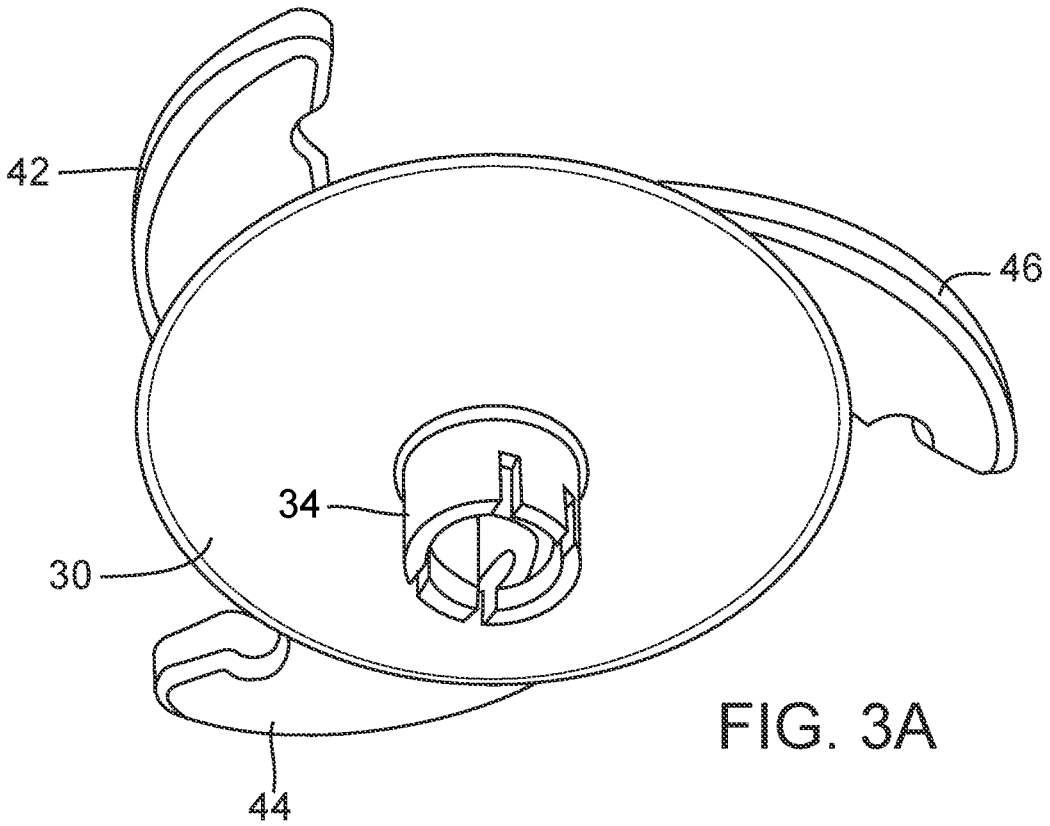
Figure 3B:
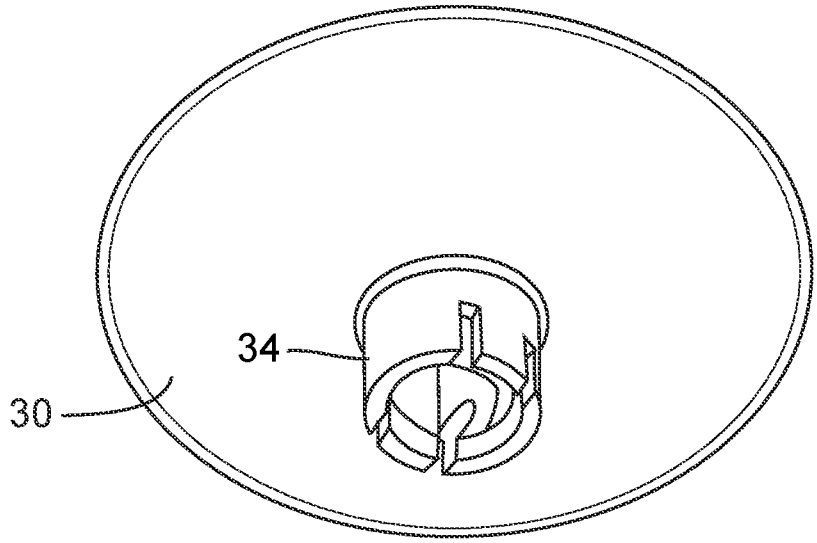
FIG. 3B is a similar view but showing the sectors inward, in a closed position.
Figure 4A:
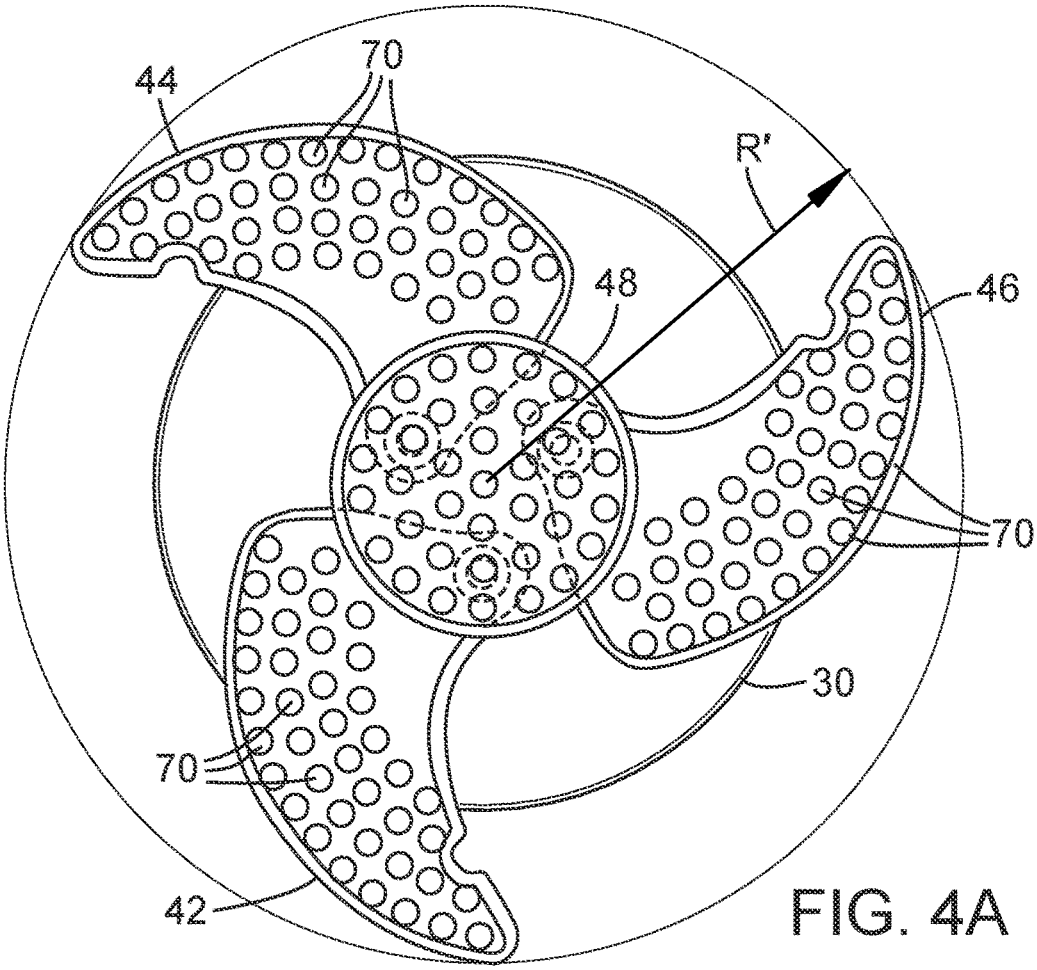
FIGS. 4A and 4B are plan views showing the distal side of the brush head, with working sectors swung outwardly in an open position, and inwardly in a closed position, respectively.
Figure 4B:
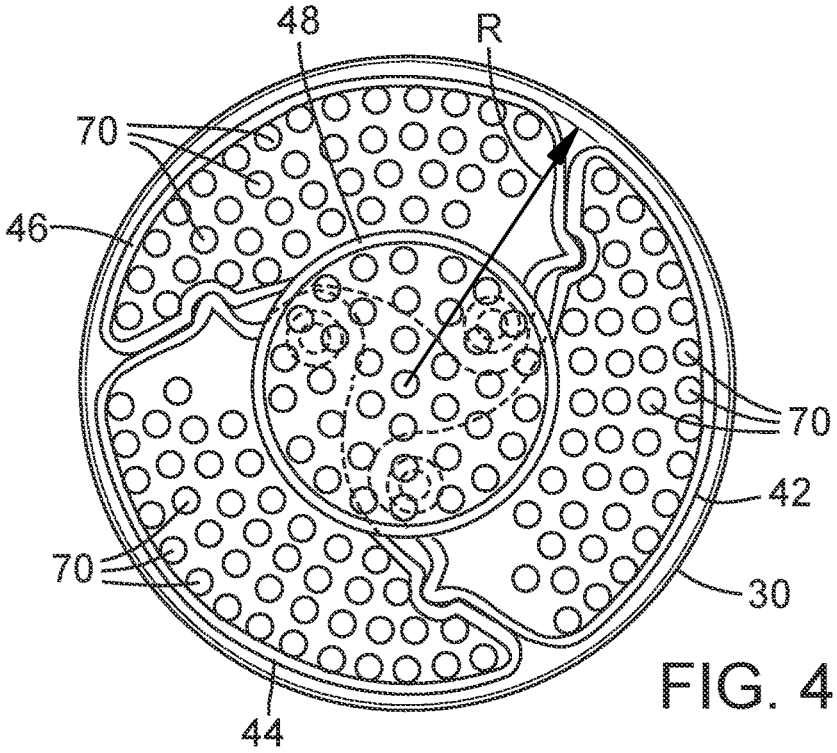
Figure 5A:
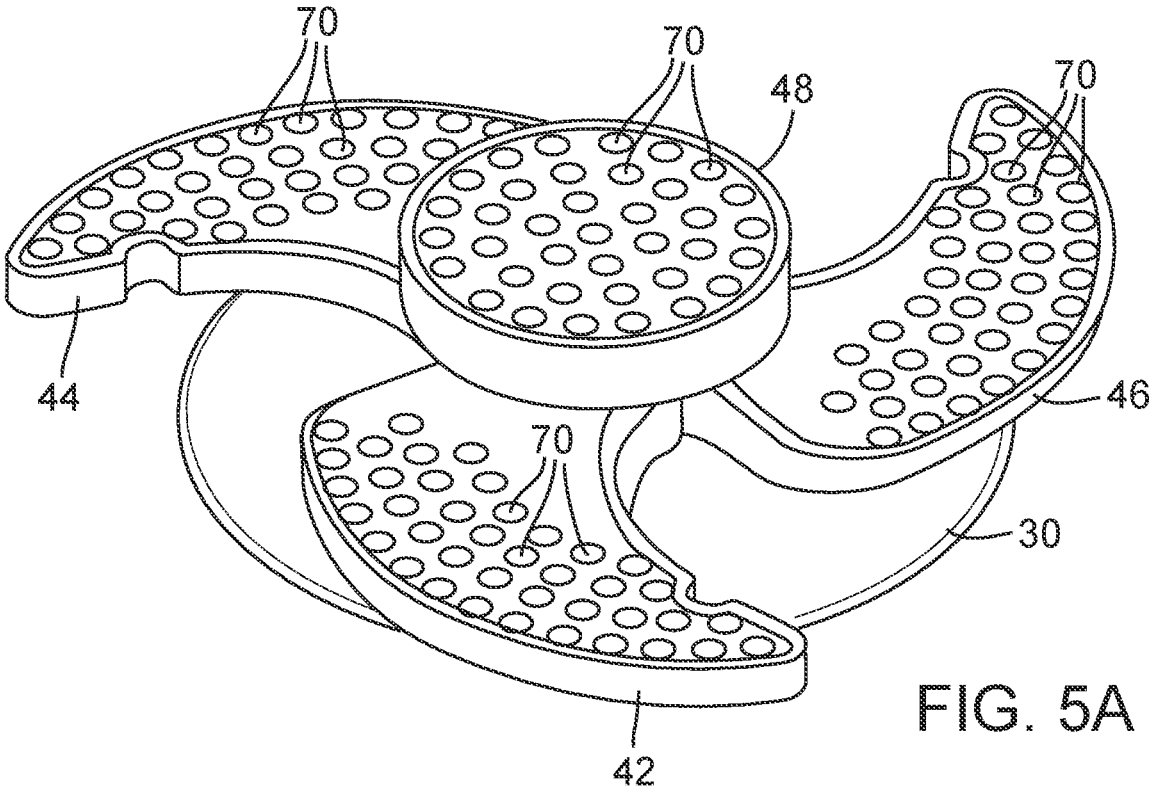
FIGS. 5A and 5B are perspective views again showing the distal side of the brush head, with sectors open and with sectors closed, respectively.
Figure 5B:
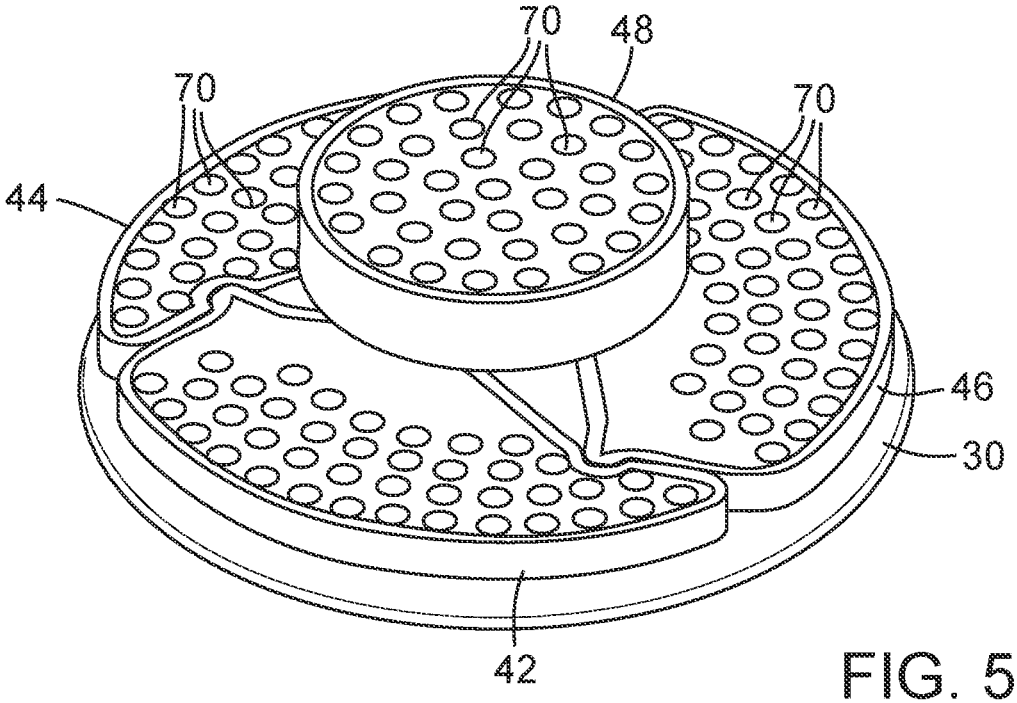
Figure 6:
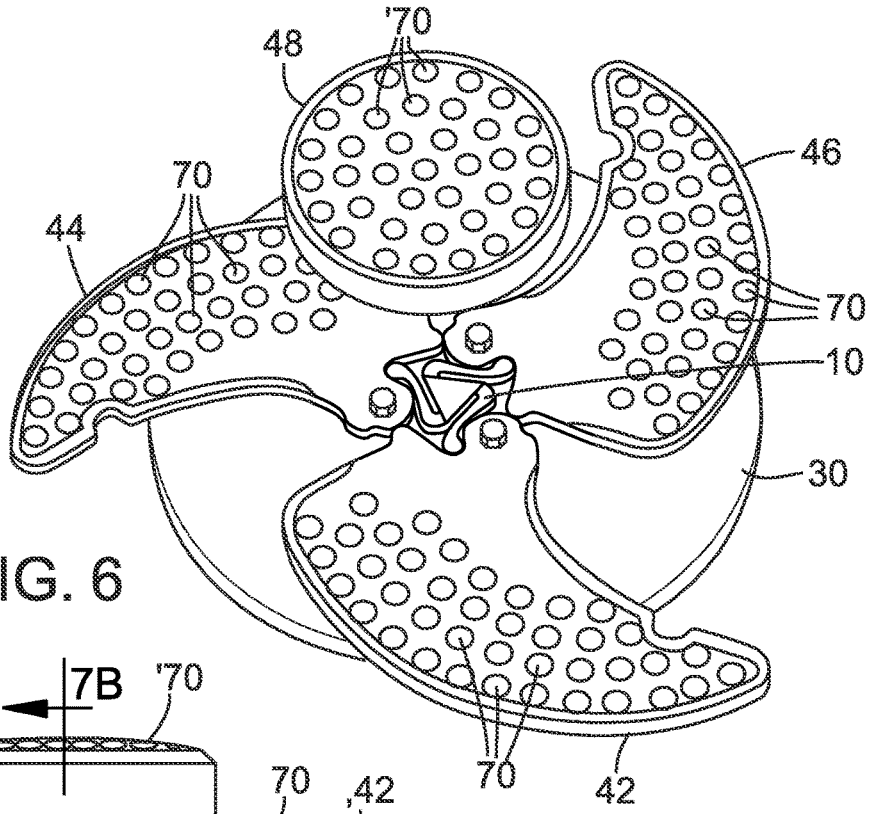
Figure 7A:
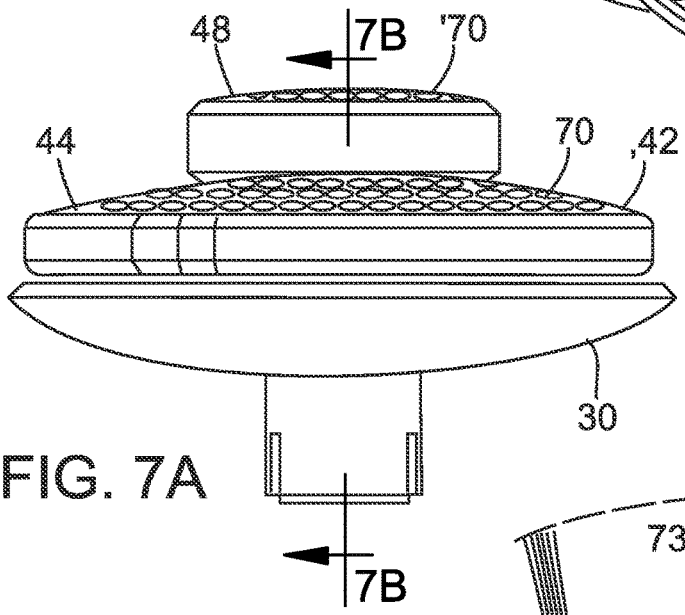
FIG. 7A is a side elevation view showing the brush head, with articulating sectors in the closed position.
Figure 7B:
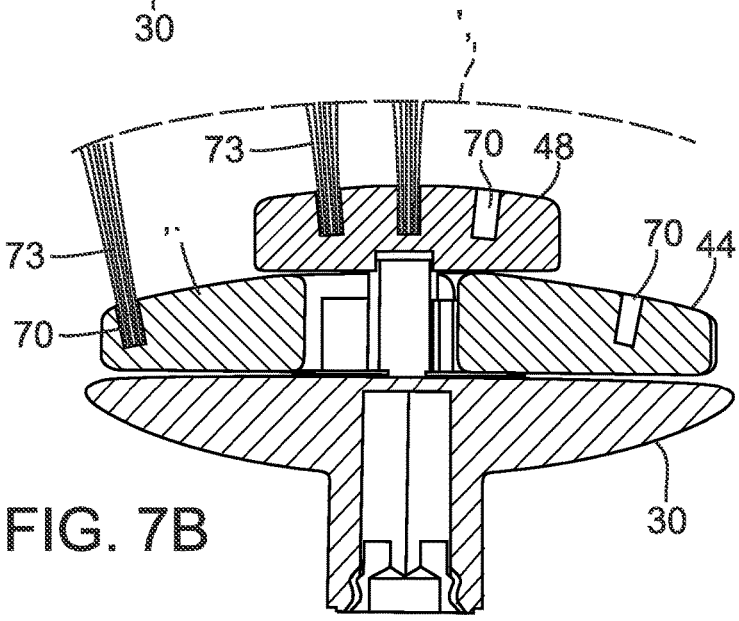
FIG. 7B is an elevation view but showing the brush head in cross section.
Figure 7C:
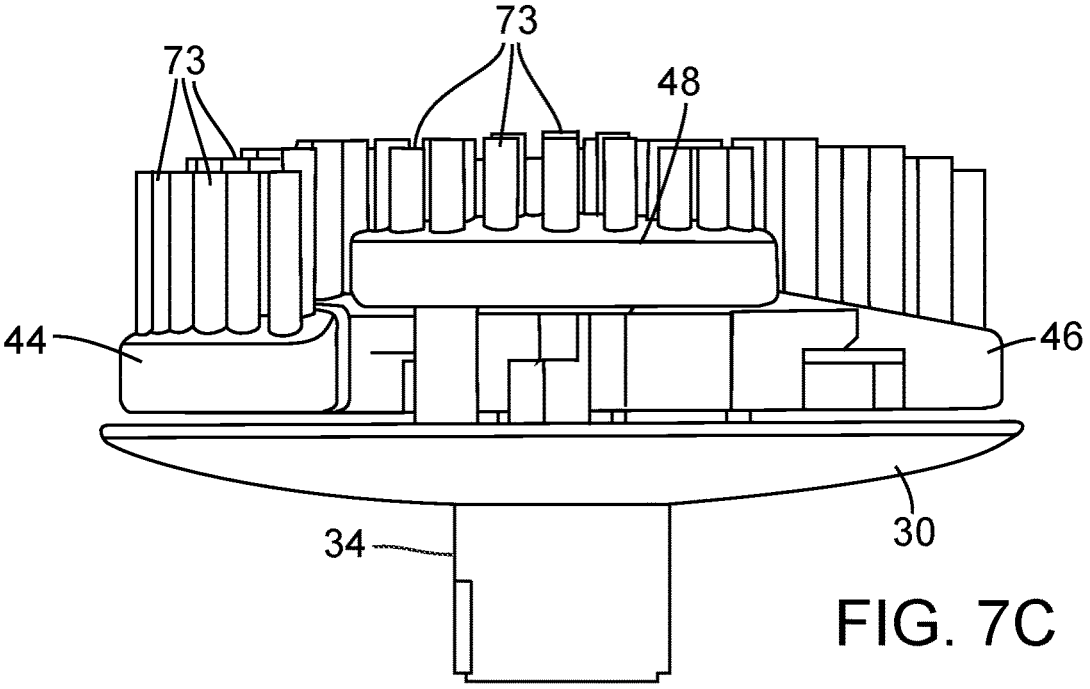
FIG. 7C is another side elevation view of the brush head, indicating bristles and with a portion of the brush head removed.

When viewed from the side and in the closed position, the articulating support members 42, 44 and 46 sit below the non-articulating member 48. See FIGS. 5A, 5B and 6. When viewed from the side and in cross section (FIGS. 7A and 7B), it is apparent than the lengths of the tufts need to be different in the center 48 because of the elevation protrusion of the bristle tuft holes 70 compared to the bristle tuft holes in 42, 44 and 46 (also shown as items 70 in FIG. 7B). The center protrudes distally. This tuft length difference is easily accomplished as can be seen in FIG. 7B. Here, bristle tufts 73 in the center sector 48 can be much shorter than bristle tufts 73 in one of the articulating working element holders (item 44, FIG. 7B). This can result in the top surface of the working elements (item 74, FIG. 7B) being cohesive as essentially one surface, including as a simple cohesive shape such as a dome, FIG. 7B. Another view of the same facet of the invention can be seen in FIG. 7C, which is a view from the same direction as FIG. 7B. However, FIG. 7C is not in cross section and elements 42 and 52 (one sector) are removed for clarity. Here it can be seen that the bristle tufts 73 in item 48 are shorter than the bristle tufts 73 in Item 44.

The center working element segment 48 does not offer much in the way of cleaning power. It is small, close to and surrounding the center of rotation and there would be very few locations on the body where the center working element 58 could be used as the primary working element. While the sector 48 and 58 can be minimized or even eliminated, it does offer some advantages. First, with its presence, it does show the user essentially a continuous field of working element. This can be perceived as more cleaning power and is more similar to the existing state of the art of brush heads than if there were a void of working element in the center of the brush head. Most importantly, it can be used to stabilize and strengthen the articulating working element segments (42, 44 and 46) by receiving the ends of the pivot posts 32, and is preferred. It can also cover and enclose some additional mechanism. One such mechanism would be a detent spring (item 10 in exploded view FIG. 6 where 48 is exploded upward off of posts 32 in order to expose item 10—see description of FIGS. 11 and 12, below).

Figure 11:
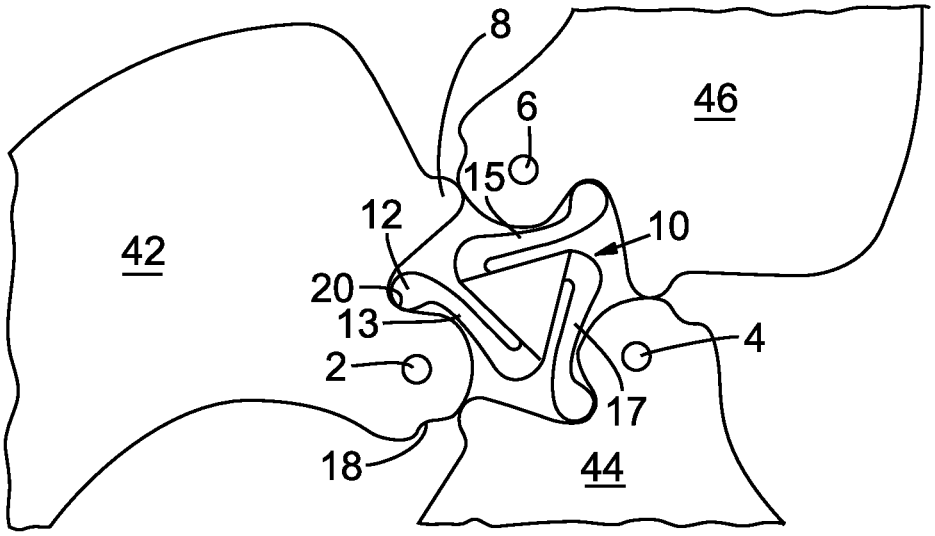
FIG. 11 is detail view, a partial plan view showing an example of a mechanism for detenting of the swingable segments, here shown in the open position.
Figure 12:
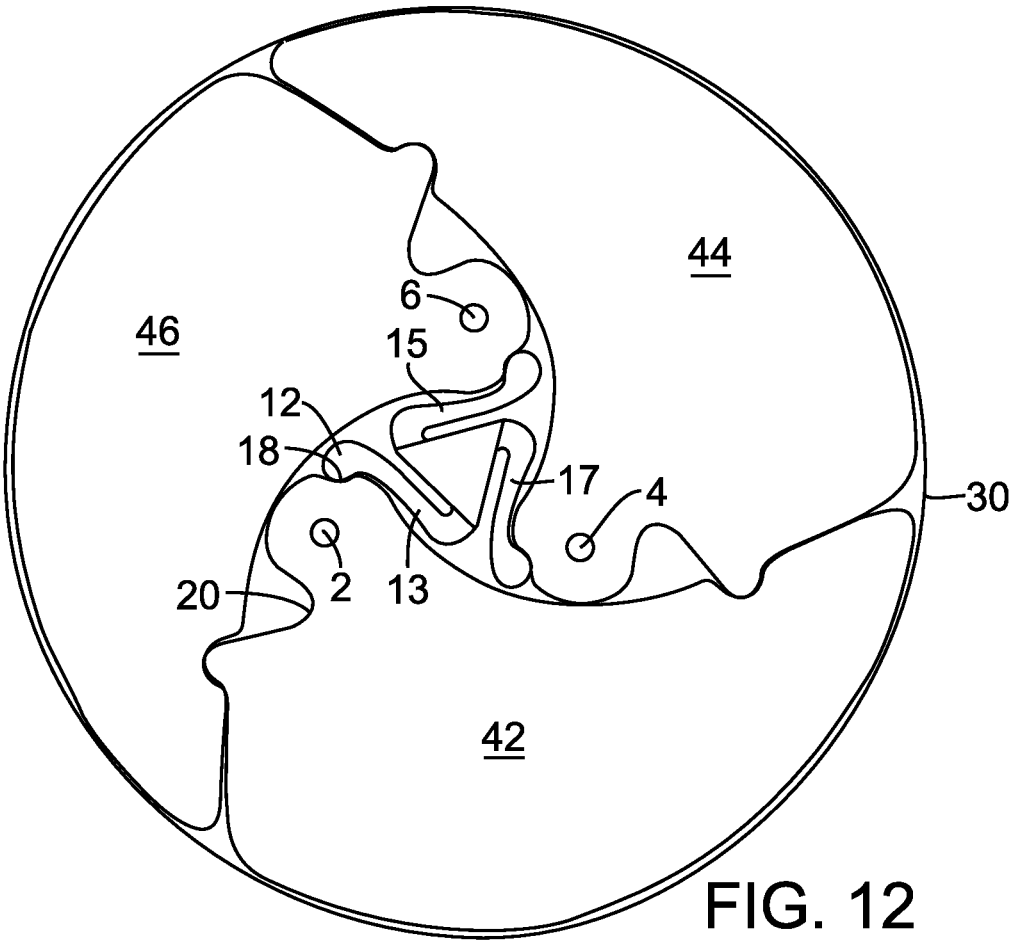
FIG. 12 is another detail view, showing the components of FIG. 11 with the segments in the closed position.

A detent spring in this embodiment is used to hold sectors 42, 44 and 46 in the closed and/or open position. This will aid the user in keeping the device in one position or the other and prevent drifting from one to the other. Or, if the user prefers one use mode over the other for all uses, this detent operates as a set-it-and-forget-it element. FIG. 11 shows the sectors/working element holders (42, 44 and 46) in the open position. Items 48, 50 52, 56, 58, 30, 70 and 72 are not shown in this fragmented detail view for clarity. As mentioned previously, each of the working element holders pivot about an axis or pivot post 32. This rotation occurs about holes 2, 4 and 6. The center portion of the spring 10 is fixed so that part is unable to rotate or translate in the plane shown. When a portion of working element holder 42 (item 8, FIG. 11), moving clockwise in FIG. 11, contacts the neighboring working element holder 46, that stops 42 in the fully open position and prevents 42 from rotating further clockwise. At this point, the end 12 of one of the arms 13 of the detent spring 10 resides in a recess 20 of item 42. When the sector 42 pivots about the axis hole 2 in a counterclockwise direction, the spring top 12 eventually resides in a recess 18 (see FIG. 12). The sector 42 is now contacting item 44 which prevents sector 42 from rotating further in a counterclockwise direction and the sector 42 is in a fully closed position (FIG. 12). When the spring tip 12 is in the position 20 or 18, the spring arm 13 is in a less strained state than when the spring tip 12 is between 20 and 18. This creates the detent feature as the spring tip 12 preferentially wants to reside in position 18 or 20. A similar result happens with sectors 44 and 46 and their corresponding detent spring arms 15 and 17.

Figure 13A:
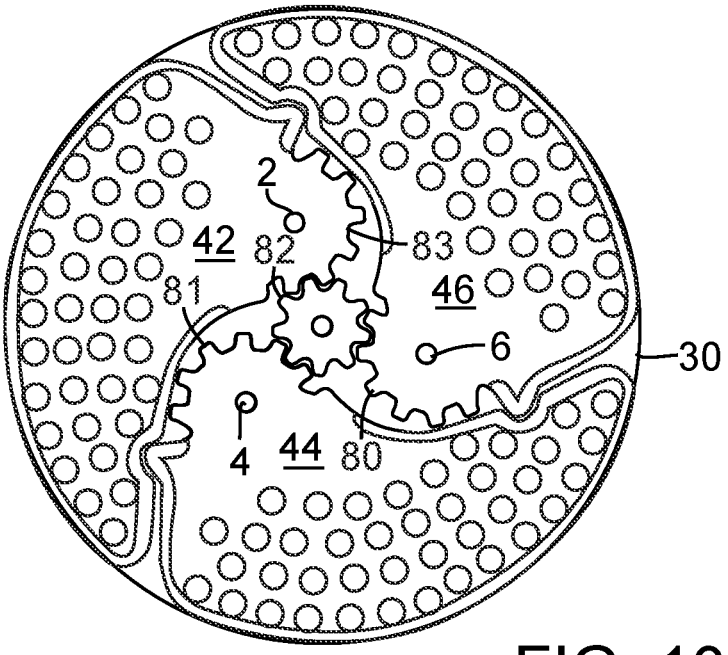
FIGS. 13A and 13B are plan views schematically indicating the distal side of an articulating brush according to the invention, with another form of mechanism for articulation of the movable sectors.
Figure 13B:
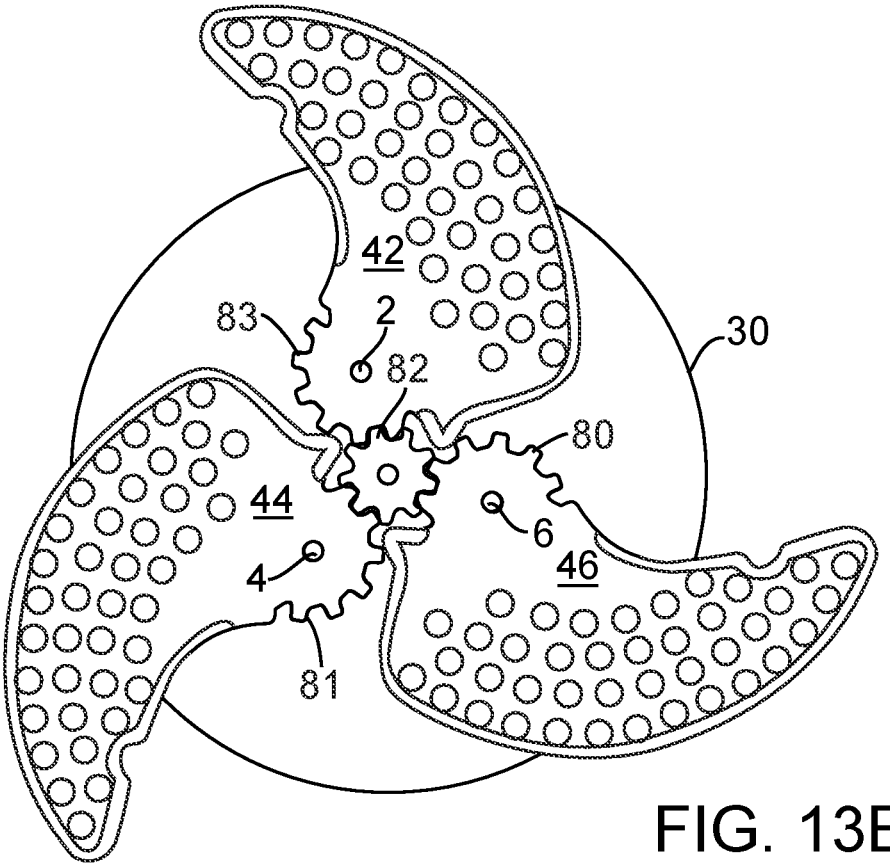

An alternative mechanism to keep the working element segments or sectors 42, 44 and 46 stable in a fully open or fully closed position is the use of a pinion gear as shown in FIGS. 13A and 13B. A pinion sector is used in place of or in combination with the detent spring 10. While the detent spring 10 was prevented from rotating, the pinion gear 82 is allowed to rotate about the center of the device. The gear engages a gear tooth segment 81 on each of the working element holders. So, when one of the segments/working element holders is rotated, that drives the pinion gear 82 which in turn drives the other working element holders in the same rotational direction and the device can be transformed from closed position (FIG. 13A) to open position (FIG. 13B). In both FIGS. 13A and 13B, items 48, 52, 54, 56, 58, 70 and 72 are not shown for clarity. As in the previous embodiment, the rotation of the segments to open position preferably is opposite the direction of rotation of the motorized brush's body 30. This will tend to open the segments when the device is pressed against a surface (e.g. skin). This may not be desired, particularly if the device is to be used in the closed, compact configuration, and a latch can be provided to retain the closed configuration, any suitable form of mechanical latch.

Figure 14:
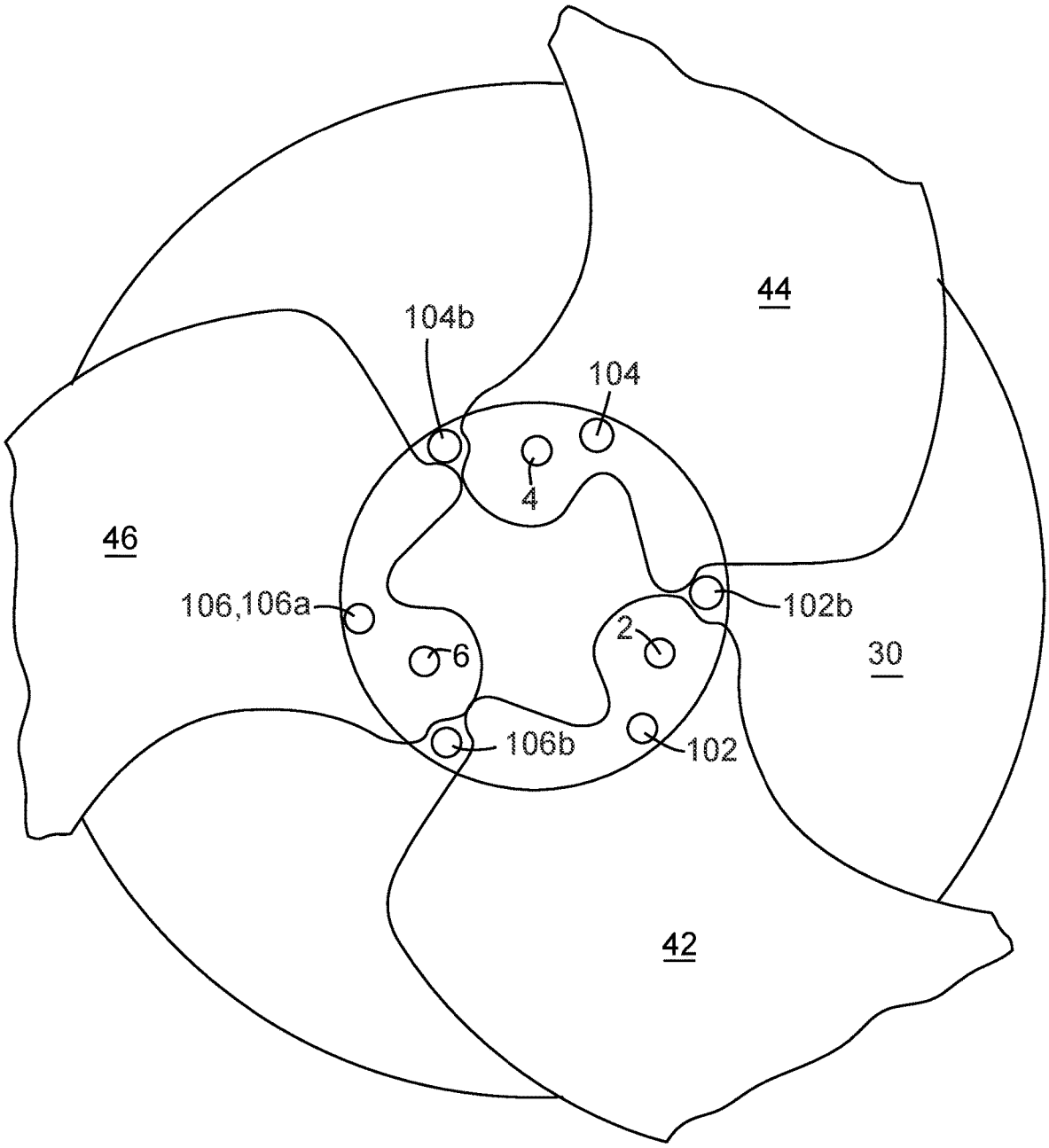
FIGS. 14-16 are schematic views showing inner portions of segments and a mechanism for holding the segments in open or in closed position.
Figure 15:
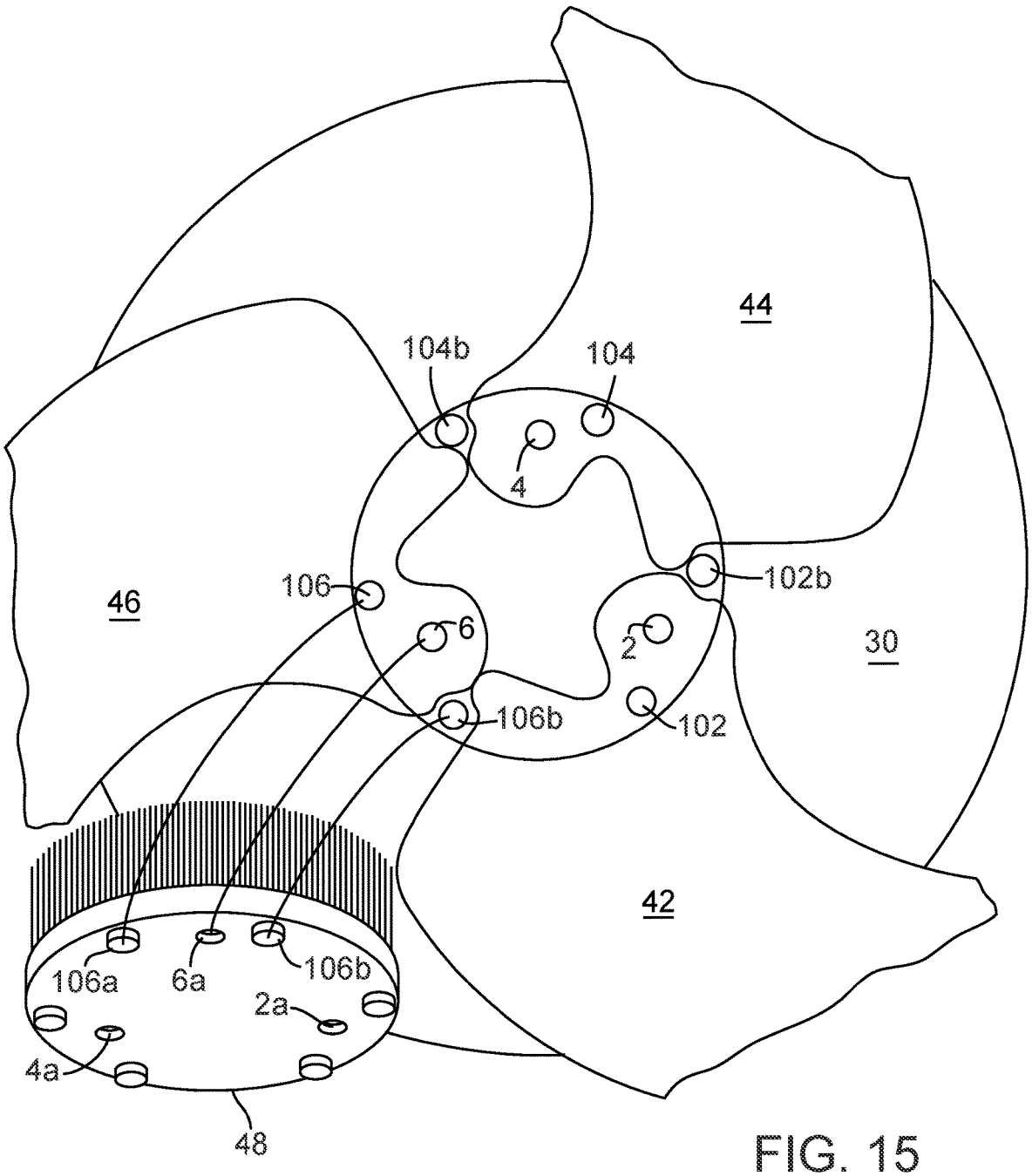
Figure 16:
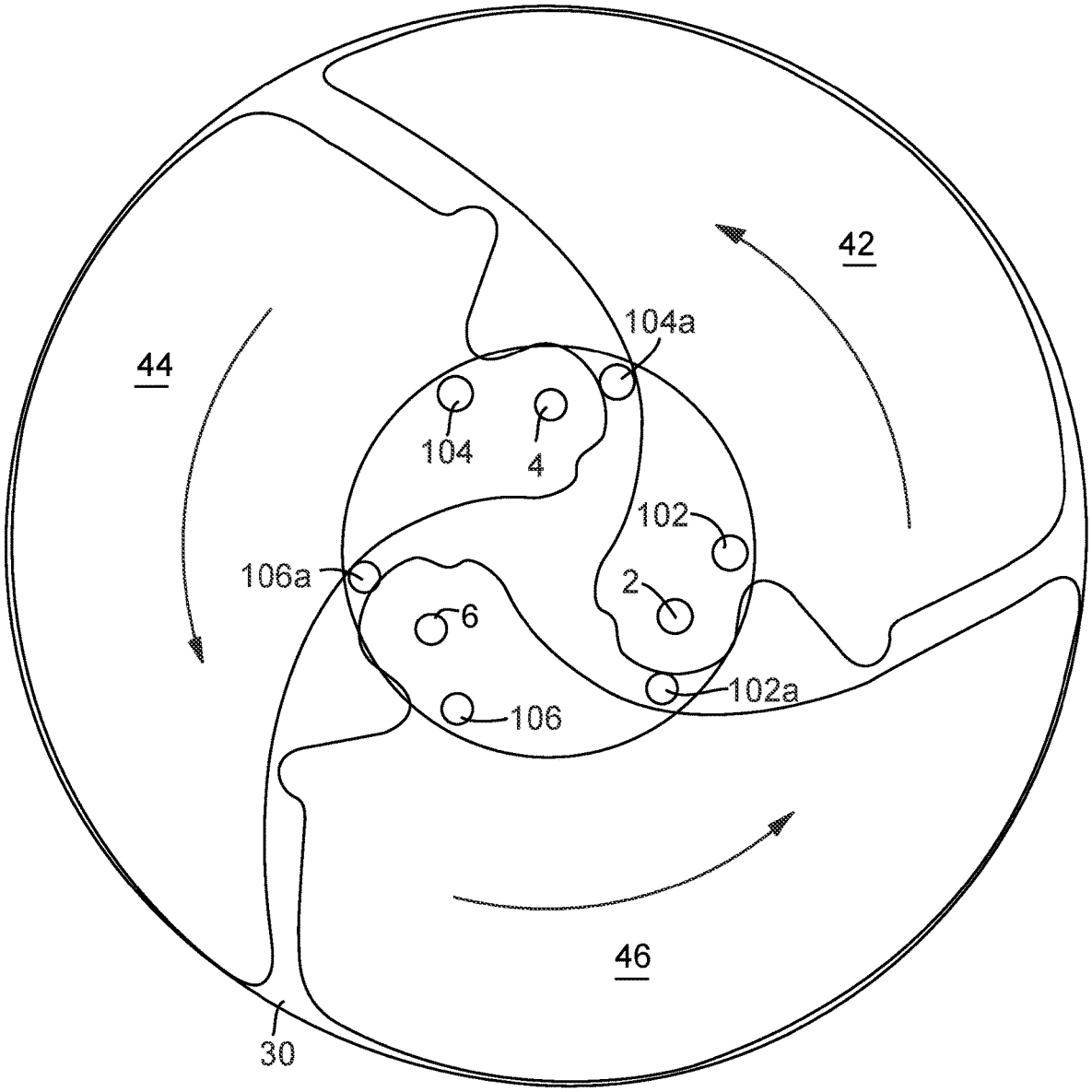

One form of latch that can be used is indicated schematically in FIGS. 14 to 16. FIG. 14 is similar to FIG. 11, showing inner portions of the three segments. The detent spring 10 has been eliminated, and the shape of the inner ends of the segments is somewhat different without the spring. Each segment is pivotal at pivot holes 2, 4 and 6, which receive the pivot posts 32 (FIG. 10) extending up from the body 30. In the open position as shown in FIG. 14, it can be seen that further holes 102, 104 and 106 are added to the three segments, 42, 44 and 46, respectively. These are for the locking function, and coordinate with the center segment 48 for this function, which is not shown in FIG. 14 but its position indicated. 106*a* and 106*b* refer to protrusions on the center segment 48 for holding positions of the segment 46.

In FIG. 15 the center segment or section 48 is seen in perspective (as well as its position being indicated in plan), and its cooperation with the three pivotal segments is indicated. When the center section 48 is put into position, it has protrusions or pegs, e.g. 106*a* and 106*b*, two adjacent to each of the pivot points. In this embodiment the segment pivot points as located on the center section can be holes 2*a*, 4*a* and 6*a*, whereas the segments have holes 2, 4 and 6 through which the protrusions (see FIG. 10) 32 pass to engage in the holes 2*a*, 4*a* and 6*a*, connecting with the center section. Taking, for example, the segment 46 at left in FIG. 15, with the pivot point 6, the protrusions 106*a* and 106*b* are provided on the bottom of the center section 48 on either side of the pivot 6, 6*a*. The same occurs at each of the other pivot points 2 and 4 of the segments 42 and 44. The center segment 48 in this case can travel somewhat along its axis, not in rotation but in/out movement, so that the locking pegs (but not the pivot points 2, 4 and 6) can be engaged or disengaged. When the center segment is moved inwardly (downwardly), pushed toward the segments 42, 44 and 46, the protrusion or peg 106*a* goes into the hole 106 and locks the segment in the open position. The same occurs on the other two segments, thus locking all three segments in the open position. In FIG. 15 the peg 106*a* is indicated to be engaged with the hole 106. Meanwhile the peg 106*b* resides between segments 42 and 46 as shown in FIG. 15.

When the center segment is pulled outwardly, this disengages the protrusions. The segments 42, 44 and 46 can then be swung to the closed position shown in FIG. 16. Once the segments have been swung to closed, the center segment 48 can be pushed inwardly, downwardly toward the segments 42, 44 and 46, and this will engage the protrusion or peg 106*b* into the hole 106, locking the segment in the closed position as in FIGS. 16 (106 and 106*b* are coincident). This occurs at all three segments, to lock them all in closed position. Note that the arrangement of the pegs 106*a* and 106*b* (as well as those on the other segments) are such that the non-used protrusion 106*a* or 106*b* will not be blocked by any structure from moving down into the locking position. In FIG. 16 the one peg 106*a* is between segments, thus residing in a clearance there, while peg 106*b* is in the hole 106.

Conversely, in FIG. 15 the peg 106*b* resides in that clearance (as noted above), while the peg 106*a* is locked in the hole 106 of the segment.

Other mechanical latch designs are possible and can easily be made by a person of skill in the art.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A rotating body brush, comprising:

a handle, a brush head connected to the handle, the brush head having a main body and being rotatable relative to the handle about a central longitudinal rotation axis, and having at least two pivotal segments of cleaning elements, pivotally connected to the main body, each segment being pivotable about a segment axis substantially parallel to said central longitudinal rotation axis, so as to allow pivoting of the segment between a closed position and an open position on the main body of the brush head, whereby when swung open on the segment axis, the cleaning elements of the segment are farther from said central longitudinal rotation axis than when closed, each segment configured to nest against an adjacent segment when closed, to form an essentially circular outer perimeter on the brush head, and each segment configured to extend radially distant from the central longitudinal rotation axis when rotated to open position, and a motor operable between the handle and the brush head to effect rotation of the brush head relative to the handle.

2. The rotating body brush of claim 1, wherein the brush head includes a central segment of cleaning elements which rotates only about along said central longitudinal rotation axis along with the main body when the brush head is rotated.

3. The rotating body brush of claim 2, wherein said central segment extends longitudinally outward, distally from the pivotal segments, such that the pivotal segments when rotated to a closed position are partly covered by the central segment.

4. The rotating body brush of claim 3, wherein cleaning elements of the pivotal segments have greater length than cleaning elements of the central segment such that the brush has all cleaning elements with ends at approximately a common plane.

5. The rotating body brush of claim 4, wherein all cleaning elements form a slightly domed surface.

6. The rotating body brush of claim 2, including three said pivotal segments.

7. The rotating body brush of claim 4, wherein the cleaning elements comprise bristles.

8. The rotating body brush of claim 1, wherein each of the pivotal segments has an arcuate outer edge such that when closed the pivotal segments form essentially a circular outer perimeter.

9. The rotating body brush of claim 8, wherein the brush head includes a central segment of cleaning elements which rotates only about along said central longitudinal rotation axis along with the main body when the brush head is rotated, and wherein each pivotal segment has a generally arcuate concave side opposite said arcuate outer side, so as to essentially nest against the adjacent segment when closed and the plurality of closed pivotal segments leaving a central area below said central segment essentially open.

10. The rotating body brush of claim 9, wherein axes of rotation of the pivotal segments are positioned beneath said central segment.

11. The rotating body brush of claim 1, wherein the cleaning elements comprise bristles.

12. The rotating body brush of claim 1, wherein the cleaning elements comprise sponges.

13. The rotating body brush of claim 1, wherein the cleaning elements comprise an elastomer.

14. The rotating body brush of claim 1, wherein the cleaning elements comprise pumice stones.

15. The rotating body brush of claim 1, wherein the brush head has a direction of rotation relative to the handle, and said segment when opening rotates in an opposite direction of rotation, so that when the rotating body brush is engaged against a surface, the pivotal segments tend to open.

16. The rotating body brush of claim 1, including a releasable mechanical means for retaining the pivotal segments in closed position.

17. The rotating body brush of claim 1, including a central pinion gear rotatable relative to the main body on said central longitudinal rotation axis, and each pivotal segment having an arcuate gear rack engaged with the pinion gear so that the pivotal segments when opening or closing rotate in unison and with rotation of the pinion gear.

* * * * *